US010758876B2

(12) United States Patent
Muhs

(10) Patent No.: US 10,758,876 B2
(45) Date of Patent: Sep. 1, 2020

(54) STIRRING TOOL AND STIRRER COMPRISING A TOOL OF SAID TYPE

(71) Applicant: SAMIX GmbH, Zirndorf (DE)

(72) Inventor: Andreas Muhs, Gotha (DE)

(73) Assignee: SAMIX GmbH, Zirndorf (DE)

( * ) Notice: Subject to any disclaimer, the term of this patent is extended or adjusted under 35 U.S.C. 154(b) by 0 days.

(21) Appl. No.: 16/697,624

(22) Filed: Nov. 27, 2019

(65) Prior Publication Data

US 2020/0094203 A1 Mar. 26, 2020

Related U.S. Application Data

(63) Continuation of application No. 15/520,536, filed as application No. PCT/EP2015/072119 on Sep. 25, 2015, now Pat. No. 10,493,413.

(30) Foreign Application Priority Data

Oct. 20, 2014 (DE) ..... 10 2014 221 239

(51) Int. Cl.
*B01F 7/00* (2006.01)
*B01F 7/16* (2006.01)

(52) U.S. Cl.
CPC ..... *B01F 7/00358* (2013.01); *B01F 7/00633* (2013.01); *B01F 7/161* (2013.01); *B01F 7/1605* (2013.01)

(58) Field of Classification Search
CPC ..... B01F 7/00358; B01F 7/00633; B01F 7/1605; B01F 7/161
See application file for complete search history.

(56) References Cited

U.S. PATENT DOCUMENTS 4,506,989 A * 3/1985 Reh ..... B01F 15/00012 366/270
6,830,369 B2 * 12/2004 Haughton ..... B01F 11/0082 366/316

* cited by examiner

*Primary Examiner* — Anshu Bhatia
(74) *Attorney, Agent, or Firm* — Boyle Fredrickson, S.C.

(57) ABSTRACT

A stirring tool for a stirrer for stirring a mixture comprises a connecting element for connecting the stirring tool to a stirring drive, drivable about a rotational axis, of the stirrer, a carrier ring, a plurality of stirring spokes disposed between the connecting element and the carrier ring, and at least one stirring boss which projects radially on the carrier ring. Two adjacent stirring spokes are arranged mutually offset in the direction of the rotational axis.

20 Claims, 6 Drawing Sheets

STIRRING TOOL AND STIRRER COMPRISING A TOOL OF SAID TYPE

CROSS-REFERENCES TO RELATED APPLICATIONS

This application is a continuation of U.S. Non-Provisional patent application Ser. No. 15/520,536, filed Apr. 20, 2017, (issued as U.S. Pat. No. 10,493,413 on Dec. 3, 2019), which is a U.S. national stage application of PCT Application No. PCT/EP2015/072119, filed Sep. 25, 2015, which claims priority to German patent application DE 10 2014 221 239.1, filed Oct. 20, 2014, the entirety of each of which is hereby expressly incorporated herein by reference.

FIELD OF THE INVENTION

The invention relates to a stirring tool and a stirrer comprising a stirring tool of said type.

BACKGROUND OF THE INVENTION

EP 2 659 958 A1 discloses a stirring tool, with which medical, pharmaceutical or cosmetic products are prepared in a stirring vessel.

SUMMARY OF THE INVENTION

An object of the present invention is to design a stirring tool of the type stated in the introduction such that a stirring result is improved.

This object is achieved according to the invention by a stirring tool for a stirrer for stirring a mixture, wherein the stirring tool comprises:

a. a connecting element for connecting the stirring tool to a stirring drive, drivable about a rotational axis of the stirrer, b. a carrier ring, c. a plurality of stirring spokes disposed between the connecting element and the carrier ring, and d. at least one stirring boss, which projects radially on the carrier ring, wherein two adjacent stirring spokes are arranged mutually offset in the direction of the rotational axis;

wherein the stirring spokes respectively have a cross-sectional shape, which is arranged in relation to a stirring tool surface with an angle of inclination different from zero; and wherein the stirring spokes respectively have a stirring spoke height (HS) along said rotational axis which is related to a stirring tool height (HW) along said rotational axis by HS≥0.75 HW.

According to the invention, it was recognized that a stirring result is improved when stirring spokes are arranged mutually offset in the direction of a rotational axis of a stirring tool. In particular, the stirring spokes are configured such that, along a virtual circular path about the rotational axis of the stirring tool, a respective centroid of adjacent stirring spokes are arranged mutually offset along the rotational axis. The offset arrangement stems in particular from the fact that the centroids of adjacent stirring spokes have different height positions with reference to the rotational axis. In particular, a stirring spoke is respectively disposed within a plane which is oriented in particular perpendicular to the rotational axis. However, it is also conceivable that a stirring spoke intersects at least once a plane oriented perpendicular to the rotational axis. In relation to a plane oriented perpendicular to the rotational axis, the stirring spoke can be arranged at an inclined angle. It is also conceivable that the stirring spoke, at least in some sections, is of curved configuration in relation to the plane oriented perpendicular to the rotational axis. A, with reference to the rotational axis, offset arrangement of the stirring spokes within the meaning of the invention is also given when the centroids of adjacent stirring spokes are disposed in a common plane perpendicular to the rotational axis, but a projection of the stirring spoke surface in the rotational direction of the stirring tool differs. This is the case, for instance, when stirring spokes of different cross-sectional shape are respectively arranged symmetrically with respect to a center plane of the stirring tool, wherein the center plane is oriented perpendicular to the rotational axis. Correspondingly, it is also conceivable that a stirring spoke has two stirring spoke blades which are arranged parallel to one another and at a distance apart along the rotational axis and, in particular, are identically configured. The spaced arrangement of the stirring spoke blades defines a stirring spoke gap. A following stirring spoke in the rotational direction can have, for instance, the contour of the stirring spoke gap, or at least a contour similar to the stirring spoke gap. An offset stirring spoke arrangement within the meaning of the present patent application is also a stirring spoke arrangement of this type. A stirring, i.e. a rotation of the stirring tool about the rotational axis causes the mixture to be mixed in the peripheral direction about the rotational axis and in a direction parallel to the rotational axis. Owing to the mutually offset arrangement of the stirring spokes, the mixture, in a stirring operation, follows a wave motion. In the case of a stirring spoke arranged comparatively higher up in the direction of the rotational axis, the mixture below this stirring spoke is stirred through. In the case of a stirring spoke arranged comparatively lower down in the direction of the rotational axis, the mixture is displaced over this stirring spoke. According to the invention, it was recognized that the offset arrangement of the stirring spokes produces an improved mixing of the components of the mixture. In particular, a comminution of solid base materials of the components in the mixture is improved. The mixture has an improved homogeneity. A mixture consists in particular of at least two different components, wherein the components can have different consistencies and, in particular, a first component can be solid and a second component liquid. It is also possible for both components to be liquid. The components can also be pasty. The components can be chosen such that the solubility of one component in the other component is not or insufficiently given. The mixture is, in particular, a medical, pharmaceutical or cosmetic product. The ready-stirred mixture is in particular a liquid or pasty substance, in particular an ointment. The mixture can also exist as a gel or in a different form and/or consistency. The mixture can exist as a suspension or emulsion. The stirring tool further comprises a connecting element in the form of a hub, for connecting the stirring tool to a stirring drive. A stirring drive can be a shaft, which transmits a stirring motion, i.e. a rotary motion, from the stirrer to the stirring tool. The shaft can be coupled, for instance via a gear mechanism, with an electric motor. The stirring tool further comprises a carrier ring, which in particular encloses the connecting element. In particular, the carrier ring is arranged coaxially to the hub. The stirring spokes are disposed between the connecting element and the carrier ring. In particular, the stirring tool has six stirring spokes. It is also possible that more than six or less than six stirring spokes are provided. The stirring spokes are arranged at equal distance apart with reference to a rotation about the rotational axis. In particular, respectively two stirring spokes are arranged diametrically opposite one another relative to the rotational axis. It is advantageous if an even number of stirring spokes is provided, i.e. two, four, six, eight, ten, twelve, etc. By the stirring spokes, the connecting element and the carrier ring are fixedly connected to one another. The stirring tool has a high rigidity and stability. That rotary motion of the stirring tool which is initiated at the connecting element is reliably transmitted to the carrier ring via the stirring spokes. On the carrier ring is arranged at least one radially projecting stirring boss. The stirring boss is provided on an outer cylindrical shell surface of the carrier ring. The stirring boss serves in particular for the defined bearing contact of the stirring tool against an inner surface of a stirring vessel. A stirring vessel, in particular a stone jar, typically has a hollow cylindrical shape. The at least one stirring boss enables an elastic bearing contact against the inner surface of the stone jar. To this end, in the region of the stirring boss a maximum external diameter of the stirring tool can be greater than an internal diameter of the stone jar. Due to the elasticity of the stirring boss and in particular of the stirring tool, an elastic deformation of the stirring tool is possible such that the at least one stirring boss bears with a defined radial pretension against the inner surface of the stone jar. An elastic bearing contact of the stirring boss against the inner surface of the stone jar is not, however, absolutely necessary. In particular, an overmeasure in which the maximum external diameter of the stirring tool is greater than the internal diameter of the stone jar can also be dispensed with. In any event, the stirring boss allows the mixture to be wiped off from the inner surface of the stone jar. Unwanted deposits on the inner surface are avoided.

A stirring tool in which at least one first stirring spoke terminates flush with a top side of the stirring tool and/or in which at least one second stirring spoke terminates flush with a bottom side of the stirring tool enables a reliable mixing of the mixture within the stone jar. It is thereby ensured that the at least one first stirring spoke can bear against a cover inner surface of the stone jar, in particular of a stone jar lid, during a stirring operation. Unwanted deposits on the cover inner surface are avoided. Correspondingly, the at least one second stirring spoke can bear during the stirring operation against a bottom surface of the stone jar and avoid unwanted deposits. The mixing is improved. The geometric stirring region of the stirring tool covers the entire stirring vessel. Shadow regions which are not mixed by means of the stirrer are avoided.

A stirring tool in which the stirring spokes respectively have a stirring spoke axis of straight-line configuration has a simplified shaping. The straight-lined configured stirring spokes enable, in particular, increased structural stability. At the same time, the stirring spokes enable an elasticity and flexibility necessary to allow an elastically deformed bearing contact of the stirring boss against the inner surface of the stone jar. The stirring spokes are in particular configured radially to the rotational axis, i.e. radially to the connecting element.

A stirring tool which has been produced from plastic, in particular from polyamide, in particular by plastic injection molding, enables a high degree of flexibility with respect to the geometric design. The plastic from which the stirring tool is produced is in particular a thermoplastic plastic. The plastic is distinguished by a high chemical resistance and is in particular comparatively hard, abrasion-resistant and temperature-resistant in order to withstand the process conditions during the stirring. A stirring tool made of such a plastic has a high wear resistance and good sliding characteristics. In particular, the stirring tool is produced in one piece. The stirring tool can have a multiplicity of geometric secondary shaped elements, which produce the improved stirring result. The secondary shaped elements can be molded on in one method step, namely by plastic injection molding. It is not necessary to use separating and/or joining production methods.

A stirring tool in which the at least one stirring boss, with reference to a rotation angle about the rotational axis, is disposed, in particular centrally, between two stirring spokes enables an improved structural flexibility of the stirring tool. The at least one stirring boss is disposed on a free portion of the carrier ring. The free portion of the carrier ring extends between two adjacent stirring spokes. In particular in the radial direction with reference to the rotational axis, the free portion of the carrier ring is unsupported, i.e. free, and thus structurally elastic.

A stirring tool having a plurality of, in particular six, stirring bosses, which in the peripheral direction of the stirring tool are arranged, in particular, evenly spaced, wherein in particular respectively two stirring bosses are arranged diametrically opposite one another with respect to the rotational axis, ensures a reliable removal of the mixture from the inner surface of the stone jar by means of the stirring bosses.

A stirring tool in which the stirring spokes respectively have a stirring spoke height which is less than a stirring tool height simplify the wavy mixing of the mixture. Wiping on the cover inner surface of the stone jar and on the bottom of the stone jar is ensured. In particular, the stirring spoke height amounts to at least 30% of the stirring tool height, in particular at least 50%, in particular at least 60%, in particular at least 70%, and in particular at least 75% of the stirring tool height.

In the case of a stirring tool in which the stirring spokes respectively have an, in particular exclusively, convexly configured cross-sectional shape, unwanted deposits of the mixture and/or components thereof on the stirring spokes are precluded. The cross-sectional shape is oriented perpendicular to a stirring spoke axis. The cross-sectional shape is in particular of lenticular or elliptical configuration. The lenticular shape is in particular arranged inclined in relation to a stirring tool surface. That means that the cross-sectional shape, which has, for instance, a principal axis, is arranged with an angle of inclination which is different from zero and measures, for instance, 30°, in relation to the stirring tool surface. The angle of inclination can also be chosen greater or less than 30°, in particular in dependence on the mixture to be produced. The greater the angle of inclination is chosen, i.e. the steeper the stirring spoke is set, the greater is the thereby generated eddying during the stirring operation. Surprisingly it was found that, through the setting of the stirring spokes, an additional eddying can be generated in a comparatively uncomplicated manner. In particular, a geometrically complex stirring spoke design, as known from EP 2 659 958 A1, is unnecessary. The production of the stirring tool is simplified.

A stirring tool in which the contour of the at least one stirring boss is of exclusively convex configuration prevents unwanted material accumulations and/or deposits.

A stirring tool in which the at least one stirring boss has a bearing portion for bearing against an inner wall of the stirring vessel, wherein the bearing portion has a bearing portion height which is less than a stirring tool height, enables an improved mixing and comminution of the mixture. A bearing portion length, i.e. an extent of the bearing portion in the peripheral direction of the stirring tool, can be differently defined. A bearing surface area of the bearing portion against the inner surface of the stone jar is obtained from the product of the bearing portion height and the bearing portion length. It is conceivable for the bearing portion length to be chosen infinitesimally small. In this case, a linear contact, i.e. no areal contact, is obtained between the bearing portion and the inner surface of the stone jar. In particular, the bearing portion is realized by a bearing edge, which is oriented parallel to the rotational axis of the stirring tool. In particular, a mixing is ensured even in a region close to the container wall. The bearing portion height amounts in particular to no more than 30% of the stirring tool height. It is thereby ensured that the stirring boss bears merely in some sections against the inner surface of the stone jar. The stirring boss serves to wipe off the mixture on the inner surface of the stone jar. The stirring boss further serves for the mixing and stirring of the mixture, in particular in a region between the carrier ring of the stirring tool and the inner surface of the stone jar.

The bearing edge can be configured such that it is oriented parallel to the inner surface of the stone jar, i.e. curved. The bearing portion is in particular arranged centrally between two adjacent stirring spokes on the carrier ring. A stirring tool of said type exhibits an improved structural elasticity. The stirring spokes act as radial supporting elements. In the region between the stirring spokes, the carrier ring is comparatively flexible. An elastic yielding of the carrier ring and of the stirring boss is possible when the stirring boss is pressed against the inner surface of the stone jar. The increased structural elasticity and structural flexibility are in particular advantageous for compact one-way paddle stirrers.

A stirring tool in which the at least one stirring boss within the bearing portion has a maximum stirring boss depth which in particular defines a maximum stirring tool diameter ensures a reliable wiping of the mixture from the inner surface of the stone jar by means of the stirring bosses.

A stirring tool in which the at least one stirring boss has a mixing portion for mixing the mixture, wherein the at least one stirring boss within the mixing portion has a reduced stirring boss depth, which in particular is less than a maximum stirring boss depth, enables an improved mixing of the mixture on an outer side of the carrier ring. In the region of the mixing portion, due to the reduced stirring boss depth, an annular gap results between the stirring boss and the inner surface of the stone jar. In this region, upon a rotary motion of the stirring tool, the mixture can flow around the stirring tool. A peripheral flow is enabled. In a stirring tool according to EP 2 659 958 A1, a flow of this type is precluded, since the stirring boss height is identical with the stirring tool height. Surprisingly it was found that the peripheral flow in consequence of the mixing portion additionally improved the mixing result. In particular, the mixing portion, at least in some sections along the outer periphery of the stirring tool, is configured parallel to the bearing portion. The mixing portion has a mixing portion height which, at least in some sections, is less than the stirring tool height. In particular, the stirring tool height is obtained as the sum of the bearing portion height and the mixing portion height. The mixing portion can extend farther along the outer periphery of the carrier ring than can the bearing portion. That means that the mixing portion, for instance along the outer periphery in a first segment, is configured in overlap with the bearing portion. The first segment can be adjoined by a second segment of the mixing portion, wherein the second segment extends in particular over the whole of the stirring tool height. The second segment of the mixing portion has an external diameter which, in particular in comparison to the bearing portion, is reduced, so that a peripheral flow between the second segment of the mixing portion and the inner surface of the stone jar is enabled.

A stirring tool in which the at least one stirring boss has a leading surface, disposed in particular on the front of the stirring boss in the rotational direction of the stirring tool, for the onflow of the mixture against the stirring boss, wherein the at least one stirring boss has along the leading surface a reduced stirring boss depth which in particular is less than a maximum stirring boss depth, enables an improved flow of the mixture. The mixing is additionally improved. In particular, the reduced stirring boss depth is variable along the rotational direction of the stirring tool, in particular increasing along the rotational direction, in particular increasing non-linearly. Upon a rotary motion of the stirring tool during a stirring operation, the mixture, in the region of a leading portion comprising the leading surface, is fed to an annular gap which tapers radially in the peripheral direction. Due to the reduced annular gap between stirring tool and stone jar inner surface, an increased flow velocity for the mixture results, whereby the stirring result is additionally improved.

A stirring tool in which a peripheral angle, related to the rotational axis, of the leading portion amounts to no more than 85% of a peripheral angle of the at least one stirring boss, additionally has improved onflow conditions for the mixture.

A further object of the present invention is to provide a stirrer which enables a stirring with improved stirring result.

This object is achieved according to the invention by a stirrer for stirring a mixture with a drivable stirring drive and with a stirring tool, connected to the stirring drive according to the invention.

According to the invention, it was recognized that a stirrer which is equipped with a stirring tool according to the invention enables an improved stirring result. The stirring tool is disposed within a stirring vessel, the stone jar. In particular, it is provided that the stirring tool remains in the stone jar following conclusion of the stirring operation. The stirring tool is in particular intended as a single-use tool. It is nevertheless possible to remove the stirring tool from the stirring vessel once the stirring operation is completed and to use it, following cleaning, for instance, for a further stirring operation. The stirring tool is driven by means of a stirring drive. To this end, the stirring tool is fastened, for instance, to a stirring shaft. In particular, a stirring tool height is less than a stirring vessel height. A relative movement between stirring tool and stirring vessel along the rotational axis of the stirring tool enables a complete mixing of the mixture in the stirring vessel.

An illustrative embodiment of the invention is explained in greater detail below on the basis of the drawing.

DESCRIPTION OF THE PREFERRED EMBODIMENTS

Figure 1:
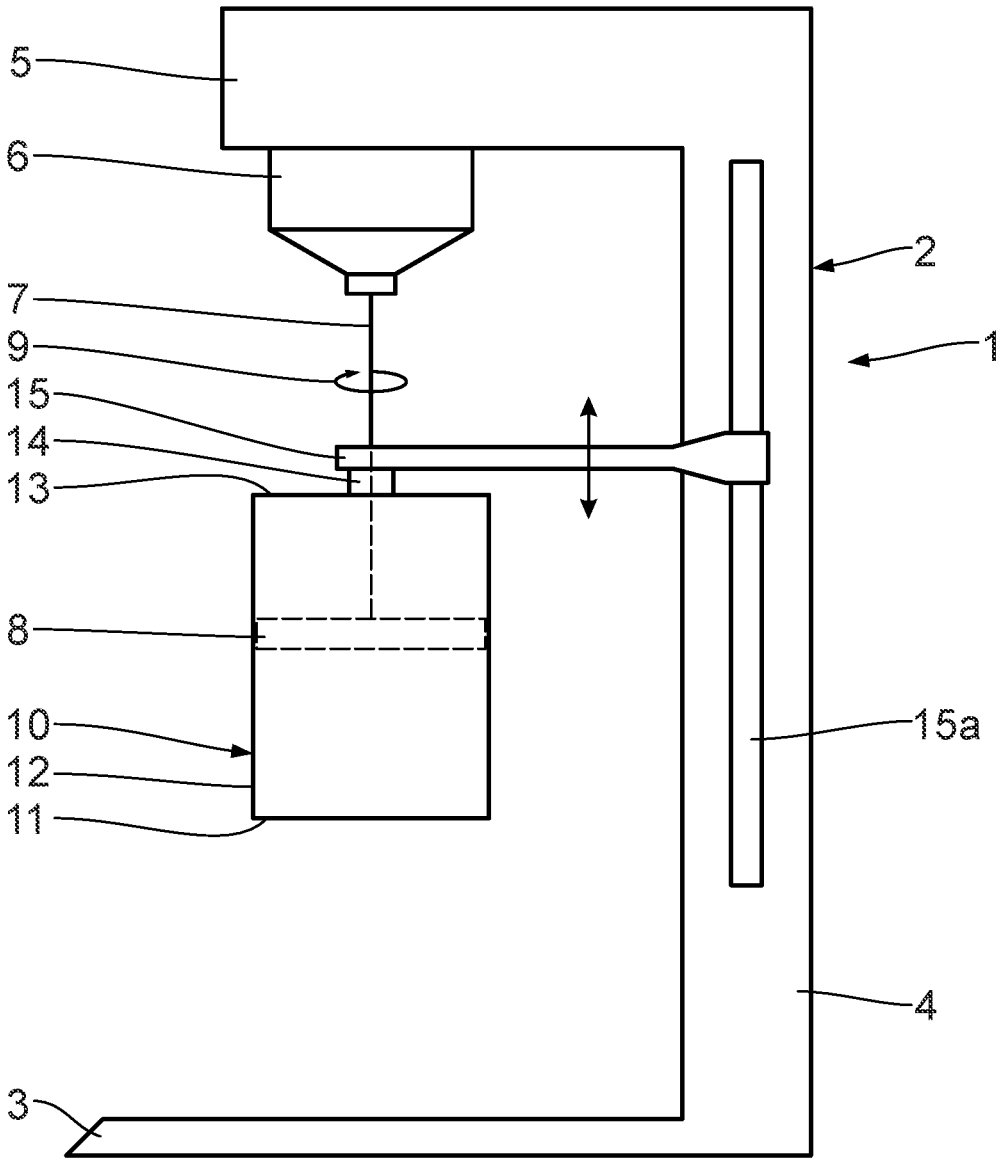
FIG. 1 shows a schematic representation of a stirrer having a stirring tool.
Figure 2:
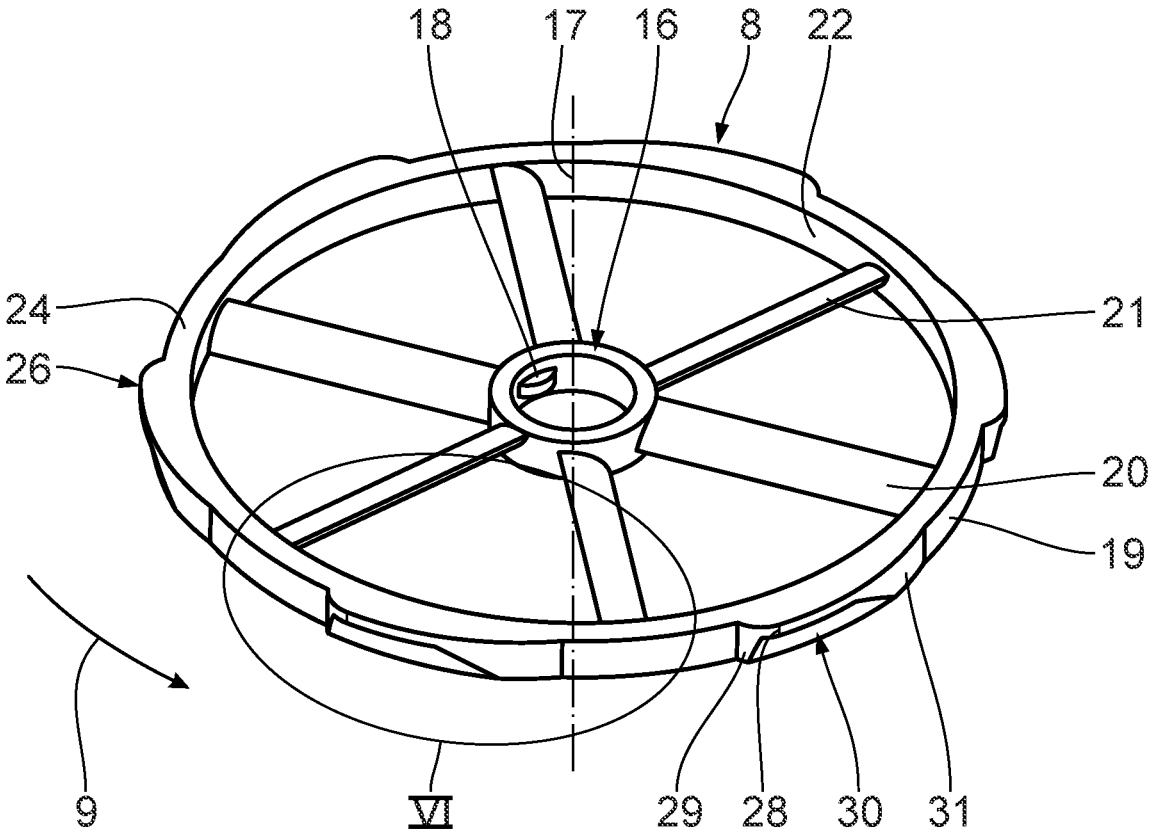
FIG. 2 shows a perspective representation of a stirring tool according to the invention.
Figure 3:
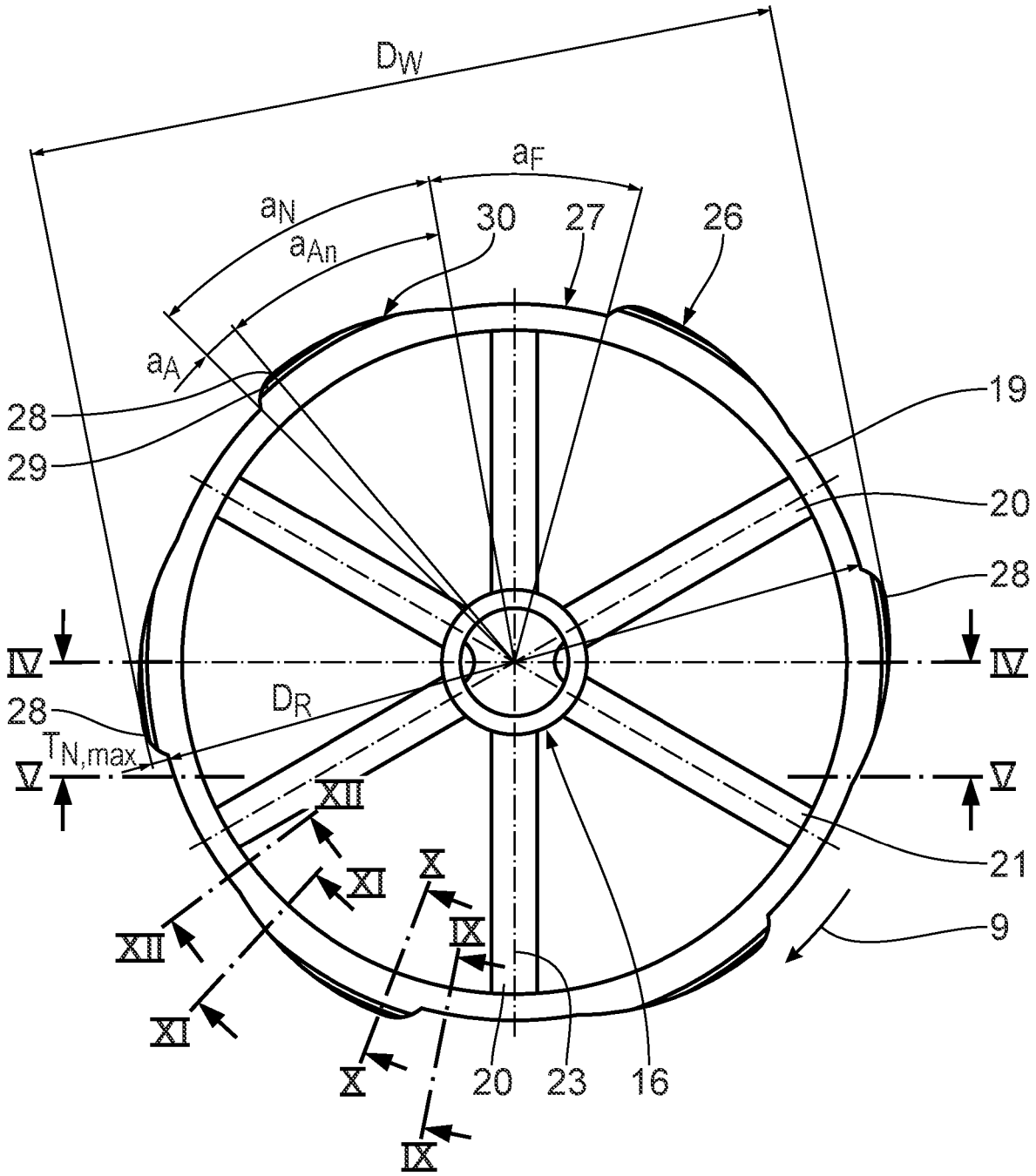
FIG. 3 shows a view from below of the stirring tool in FIG. 2.
Figure 4:
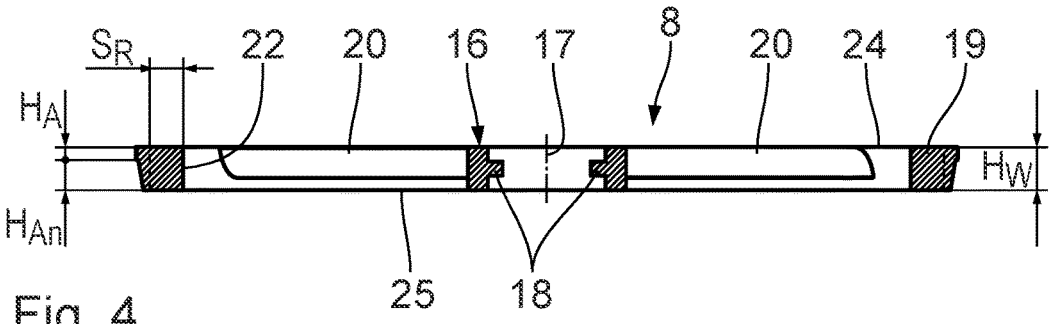
FIG. 4 shows a cross section according to the sectional line IV-IV in FIG. 3.
Figure 5:
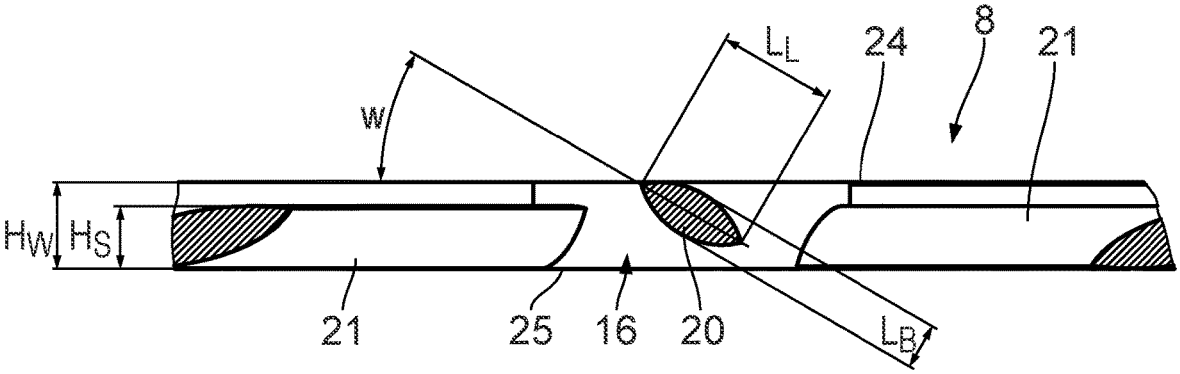
FIG. 5 shows a cross section according to the sectional line V-V in FIG. 3.
Figure 6:
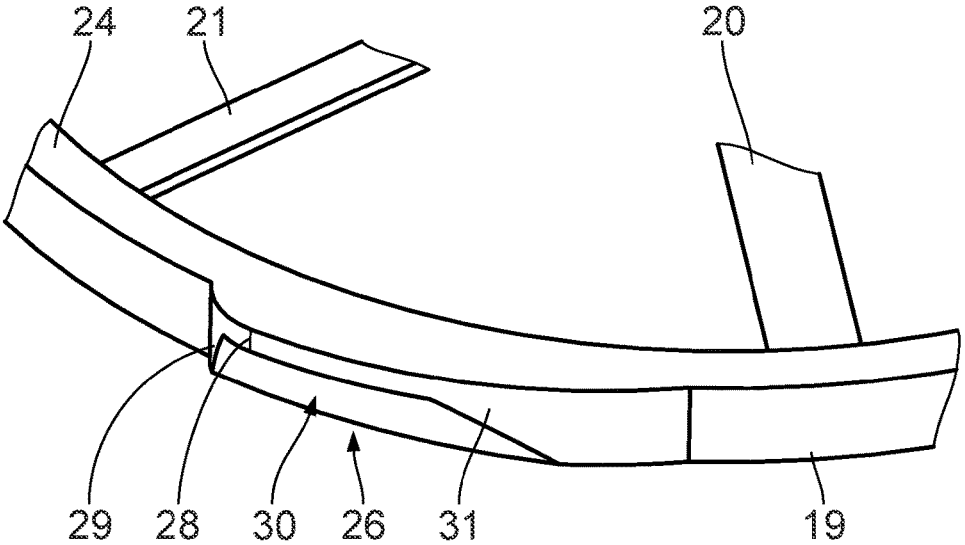
FIG. 6 shows an enlarged detailed representation of a stirring boss according to the detail VI in FIG. 2.
Figure 7:
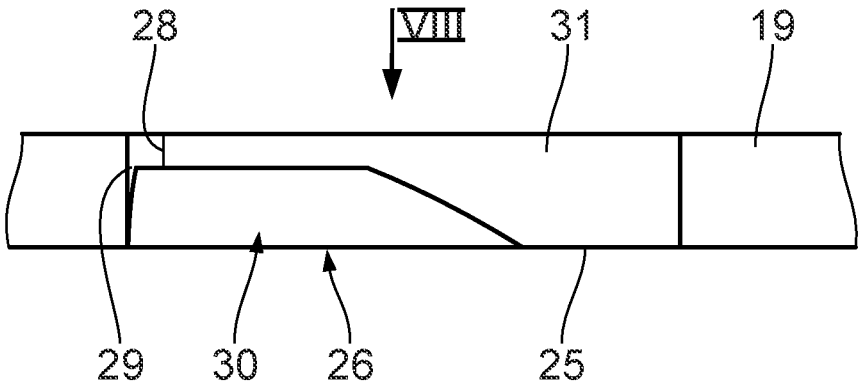
FIG. 7 shows an enlarged side view of a stirring boss.
Figure 8:
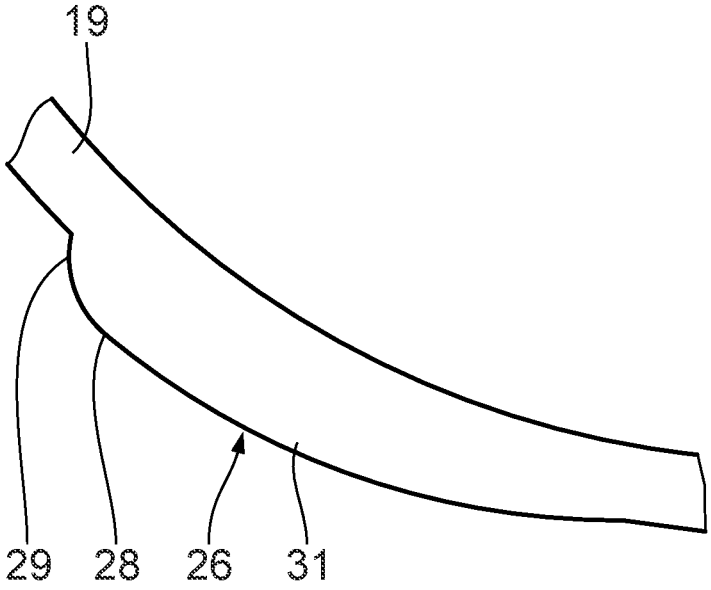
FIG. 8 shows a view according to the arrow VIII in FIG. 7.

A stirrer 1 (represented in FIG. 1) serves to stir a mixture, in particular for medical, pharmaceutical or cosmetic products. The stirrer 1 has a substantially C-shaped frame 2, comprising a base 3, a vertical column 4 and a supporting arm 5. The supporting arm 5 is oriented in particular horizontally and in particular parallel to the base 3. The supporting arm 5 bears a stirring drive 6, which is configured as an electric motor. The stirring drive 6 is coupled, in particular via a gear mechanism, with a stirring shaft 7. A rotary motion of the stirring drive 6 is transmitted to the shaft 7 and to a stirring tool 8 connected thereto. The rotary motion of the shaft 7 is marked by the arrow 9. The shaft 7 is guided into a stirring vessel 10, which is referred to as a stone jar, and connected to the stirring tool 8 disposed in the stone jar. The stone jar has a bottom 11, a cylindrical side wall 12 and a lid 13. The lid 13 is held in a lifting fixture 15 by means of a holding portion 14. The lifting fixture 15 is configured as a cantilever arm and is vertically movable along the vertical column 4, as is indicated by a double arrow. For this, a driven linear guide 15*a*, for instance a spindle drive, is provided.

For a stirring operation, the stirring tool 8 is introduced into the stirring vessel 10 and the stirring vessel 10 is sealed by means of the lid 13. The stirring operation, i.e. the mixing of the mixture, is realized by driving of the stirring tool 8 along the rotational direction 9. In addition, a vertical movement of the lifting fixture 15 with the stirring vessel 10 fastened thereto can be realized. A relative movement in the vertical direction between stirring vessel 10 and stirring tool 8 is thereby ensured.

The stirring tool 8 is more closely illustrated in FIGS. 2 to 12. The stirring tool 8 is produced from plastic, and in particular from polyamide. The surface of the stirring tool 8 has a smooth and, in particular, high-gloss finish. The risk of an unwanted material adhesion to the stirring tool 8 is thereby reduced.

The stirring tool 8 comprises a connecting element 16 in the form of a hub. With the connecting element 16, the stirring tool 8 is connectable about a rotational axis 17 to the shaft 7. The rotational axis 17 of the stirring tool 8 corresponds to the rotational axis of the shaft 7. The stirring tool 8 is accommodated and held coaxially on the shaft 7. The connecting element 16 is of ring-shaped configuration. On an inner side of the ring are provided two latching elements 18, which ensure a latching connection to corresponding recesses on the shaft 7. The stirring tool 8 is held on the shaft 7 with reference to a rotation about the rotational axis 17 and in the axial direction of the rotational axis 17. The latching elements 18 have in a plane oriented perpendicular to the rotational axis 17 a segment-like contour.

The stirring tool 8 further has a carrier ring 19. An inner shell surface 22 of the carrier ring 19 can have a taper. That means that the inner shell surface 22 has a conical course with reference to the rotational axis 17, wherein the cone angle is less than 5° and in particular measures at least 0.5°. The taper facilitates the removal of the stirring tool 8 from a plastic injection molding mold. The carrier ring 19 is arranged coaxially to the connecting element 16. The carrier ring 19 is arranged coaxially to the rotational axis 17. The carrier ring 19 encloses the connecting element 16. In a height direction which is oriented parallel to the rotational axis 17, the carrier ring 19 and the connecting element 16 are of equal height. The carrier ring 19 and the connecting element 16 define a stirring tool height $H_W$. According to the shown illustrative embodiment, the stirring tool height $H_W$ measures 3 mm. The carrier ring 19 has a ring thickness $s_R$ of 2 mm. The ring thickness $s_R$ is of importance for the structural elasticity of the carrier ring 19 and thus of the stirring tool 8. The structural elasticity of the stirring tool 8 is all the greater, the lesser the ring thickness $s_R$ is. In order to increase the structural elasticity, for instance, in relation to the shown illustrative embodiment of the stirring tool 8, the ring thickness $s_R$ can be chosen less than 2 mm. The carrier ring 19 has a ring diameter $D_R$ which, according to the shown illustrative embodiment, measures 54.4 mm.

Between the connecting element 16 and the carrier ring 19 are arranged six stirring spokes 20, 21. According to the shown illustrative embodiment, the stirring tool 8 comprises three first stirring spokes 20 and three second stirring spokes 21, which are arranged alternately in the peripheral direction about the rotational axis 17. The first stirring spokes 20 are respectively arranged such that they terminate flush with a top side which corresponds to the stirring tool surface 24. The second stirring spokes 21 are arranged such that they terminate flush with a bottom side 25 of the stirring tool 8. That means that two adjacent stirring spokes 20, 21 are arranged mutually offset in the direction of the rotational axis 17. Two adjacent stirring spokes 20, 21 have a height offset. The second stirring spokes 21 are arranged inclined with an angle of inclination in relation to the tool surface 24, wherein the angle of inclination of the second stirring spokes 21 corresponds to the negative angle of inclination of the first stirring spokes 20. For the angle of inclination w' of the second stirring spokes 21: $w'=-w$ or $w'=180°-w$. As a result of this arrangement of the stirring spokes 20, 21, an improved stirring result is possible. The six spokes 20, 21 are arranged radially with reference to the rotational axis 17. The stirring spokes 20, 21 respectively have a stirring spoke axis 23. The stirring spoke axes 23 are respectively of straight-line configuration. The stirring spoke axes 23 are oriented radially to the rotational axis 17.

The stirring spokes 20, 21 are arranged equally spaced with reference to a rotation angle about the rotational axis 17. The angle between two adjacent stirring spokes 20, 21 measures 60°. The intervening angle between two adjacent stirring spokes 20, 21 can be chosen larger or smaller in dependence on the number of stirring spokes.

The stirring spokes 20, 21 respectively have a cross-sectional shape which is oriented perpendicular to the stirring spoke axis 23 and which is of exclusively convex configuration. According to the shown illustrative embodiment, the cross-sectional shape is of lenticular configuration. The lenticular cross section has a lenticular length $L_L$ and a lenticular width $L_B$. A principal axis of the cross-sectional shape, which is oriented along the lenticular length $L_L$, is arranged inclined with an angle of inclination w in relation to a stirring tool surface 24. According to the shown illustrative embodiment: $L_L$=4 mm, $L_B$=1.6 mm and w=30°.

The stirring spokes 20, 21 have a stirring spoke height $H_S$ which is less than the stirring tool height $H_W$. According to the shown illustrative embodiment, the stirring spoke height $H_S$ amounts to 70% of the stirring tool height $H_W$.

On the carrier ring 19 are arranged six radially projecting stirring bosses 26. That means that the stirring tool 8 has precisely as many stirring spokes 20, 21 as stirring bosses 26. The stirring tool diameter $D_W$ is defined by the stirring bosses 26, in particular by their maximum stirring boss depth $T_{N,max}$. According to the shown illustrative embodiment, the maximum stirring tool diameter $D_R$ measures 57.3 mm. The stirring boss depth $T_N$ is oriented in the radial direction with respect to the rotational axis 17.

The stirring bosses 26 are respectively, in a portion 27 between two stirring spokes 20, 21, integrally molded onto the carrier ring 19. That means that the stirring bosses 26 and the stirring spokes 20, 21 are arranged mutually offset. With reference to the rotational axis 17, a stirring boss 26 extends along a stirring boss included angle $a_N$ of 35°. A free region having a free region included angle $a_F$ correspondingly measures 25°. That means that the stirring boss 26 along the outer periphery of the carrier ring 19, in particular with reference to an included angle of the rotational axis 17, extends farther than the free region between two adjacent stirring bosses 26. Respectively two stirring bosses 26 are arranged diametrically opposite one another with respect to the rotational axis 17. The stirring tool 8 is supported via the stirring bosses 26 reliably against the inner surface of the stone jar. The stirring bosses 26 respectively have an exclusively convexly configured contour. Each stirring boss 26 has a bearing portion 28, a mixing portion 29 and a leading portion 30. The leading region 30 has a leading surface 31.

The bearing portion 28 serves to bear against an inner wall of the stirring vessel 10. The bearing portion 28 has a bearing portion height $H_A$. The bearing portion height $H_A$ is less than the stirring tool height $H_W$. The bearing portion height $H_A$, according to the shown illustrative embodiment, amounts to 30% of the stirring tool height $H_W$. According to the shown illustrative embodiment, the bearing portion 28 is a bearing edge. The bearing portion 28 is of linear configuration. The line is oriented parallel to the rotational axis 17. In the peripheral direction about the rotational axis 17, the bearing portion 28 according to the shown illustrative embodiment has merely an infinitesimal spread. According to the shown illustrative embodiment in FIG. 3, the bearing portion 28 is arranged with reference to a rotation angle about the rotational axis 17, along the rotational direction 9, 30° behind a front spoke 20, 21 facing the mixing portion 29 and, say, 60° ahead of a following spoke 20, 21 facing the leading region 30. The bearing portion 28 divides the free portion 27 approximately in the ratio 1:2. The bearing portion 28 can also be arranged centrally on the free portion 27 between two adjacent spokes 20, 21. In dependence on a mixing result to be obtained, in particular in dependence on the components to be mixed, the stone jar size and/or the stirring speed, i.e. the generated stirring dynamic, the stirring bosses 26 can be appropriately secured on the carrier ring.

With reference to the rotational axis 17, the bearing portion 28 can extend along an included angle of, for instance, 2° to 15°. In the region of the bearing portion 28, the stirring boss 26 has the maximum stirring boss depth $T_{N,max}$. According to the shown illustrative embodiment, the maximum stirring boss depth $T_{N,max}$ measures 1.4 mm. According to the shown illustrative embodiment, the bearing portion 28 is configured as a dividing edge between the mixing portion 29 and the leading surface 31.

The stirring boss depth $T_N$ is variable along the rotational direction 9. On the front of the stirring boss 26 in the rotational direction 9 is arranged the leading surface 31. In the region of the leading portion 30, the stirring boss depth rises up to the maximum stirring boss depth $T_{N,max}$ at the transition to the bearing portion 28. The leading surface 31 extends within an included angle $a_{An}$, which, according to the shown illustrative embodiment, measures 30°. Starting from the carrier ring 19, the leading surface 31 extends counter to the rotational direction 9 firstly over the complete stirring tool height $H_W$, whereupon a portion with reduced height follows. The reduced height corresponds in particular to the bearing portion height $H_A$.

The mixing portion 29 extends within the included angle $a_A$ in the peripheral direction. According to the shown illustrative embodiment, the included angle $a_A$ measures 5°. The bearing portion 28 has the bearing portion height $H_A$. The leading portion 30 has a leading portion height $H_{An}$. The sum of the two portion heights, i.e. the bearing portion height $H_A$ and the leading portion height $H_{An}$, corresponds to the stirring tool height $H_W$.

The mixing portion 29 and/or the leading portion 30 are distinguished by the fact that a gap is formed between an inner side of the stirring vessel and an outer cylinder surface of the stirring tool 8. Beneath the bearing portion 28 at which the maximum stirring boss depth $T_{N,max}$ obtains, the gap is formed by a radial depression of the stirring boss 26. Starting from the bearing portion 28, the depression extends in the peripheral direction, both in and counter to the rotational direction 9, beneath the bearing portion 28 with reference to the longitudinal axis 17. The depression is part of the leading portion 30.

The mixing portion 29 has a first segment having a mixing portion height which substantially corresponds to the bearing portion height $H_A$. The first segment of the mixing portion 29 directly adjoins the bearing portion 28 counter to the rotational direction 9. Counter to the rotational direction 9, the first segment is adjoined by a second segment of the mixing portion 29. The mixing portion 29 has in the second segment, as the height, the stirring tool height $H_W$. With the second segment, the mixing portion 29 is molded onto the carrier ring 19.

Figure 9:
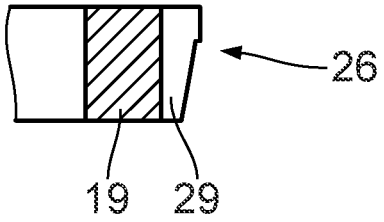
FIG. 9 shows a sectional representation according to the sectional line IX-IX in FIG. 3.
Figure 10:
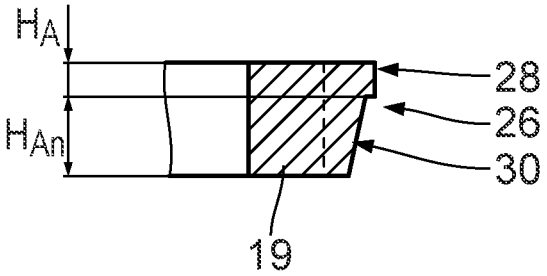
FIG. 10 shows a sectional representation according to the sectional line X-X in FIG. 3.
Figure 11:
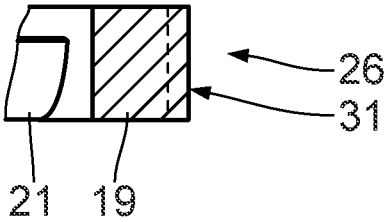
FIG. 11 shows a sectional representation according to the sectional line XI-XI in FIG. 3.
Figure 12:
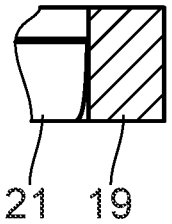
FIG. 12 shows a sectional representation according to the sectional line XII-XII in FIG. 3.

The geometry of the stirring boss 26 is illustrated once again on the basis of the sectional representations in FIG. 9 to FIG. 12. FIG. 9 shows a cross section through the carrier ring 19 along the sectional line IX-IX. The sectional line is defined outside the stirring boss 26. Correspondingly, the mixing portion 29 is visible. In a region represented at the top in FIG. 10, with the bearing portion height $H_A$ the bearing portion 28 is provided. Below, with the leading portion height $H_{An}$, the leading portion 30 is provided. The sectional line X-X is arranged through the linear bearing portion 28 at the maximum stirring boss depth $T_{N,max}$. The leading portion 30 is in this region disposed beneath the bearing portion 28. The mixing portion 29 and/or the leading portion 30 is/are formed by a reduction in the stirring boss depth in relation to the maximum stirring boss depth $T_{N,max}$. The sectional line XI-XI is disposed in that region of the stirring boss 26 in which the stirring boss depth in total, and in particular along the whole of the stirring tool height $H_W$, is reduced. The sectional line XII-XII is, in the rotational direction 9, in front of the stirring boss 26, which therefore is not discernible. The following second stirring spoke 21 is discernible.

What is claimed is:

1. A stirring tool for a stirrer for stirring a mixture, wherein the stirring tool comprises a. a connecting element for connecting the stirring tool to a stirring drive, drivable about a rotational axis of the stirrer, b. a carrier ring, c. a plurality of stirring spokes disposed between the connecting element and the carrier ring, and d. at least one stirring boss, which projects radially on the carrier ring, wherein two adjacent stirring spokes are arranged mutually offset in the direction of the rotational axis;

wherein the stirring spokes respectively have a cross-sectional shape, which is arranged in relation to a stirring tool surface with an angle of inclination different from zero; and wherein the stirring spokes respectively have a stirring spoke height (HS) along said rotational axis which is related to a stirring tool height (HW) along said rotational axis by HS >0.75 HW.

2. The stirring tool as claimed in claim 1, wherein at least one first stirring spoke terminates flush with a top side of the stirring tool and at least one second stirring spoke terminates flush with a bottom side of the stirring tool.

3. The stirring tool as claimed in claim 1, wherein the at least one stirring boss, with reference to a rotation angle about said rotational axis, is arranged between two stirring spokes.

4. The stirring tool as claimed in claim 1, comprising a plurality of stirring bosses, which are spaced apart in a peripheral direction of the stirring tool.

5. The stirring tool as claimed in claim 1, wherein the stirring spokes respectively have a convexly configured cross-sectional shape.

6. The stirring tool as claimed in claim 1, wherein the at least one stirring boss has a bearing portion for bearing against an inner wall of a stirring vessel and wherein the at least one stirring boss includes a radial depression so as to provide under the bearing portion a gap in the radial direction between the inner wall of the stirring vessel and the stirring boss.

7. The stirring tool as claimed in claim 6, wherein the bearing portion has a bearing portion height which is less than the stirring spoke height.

8. The stirring tool as claimed in claim 6, wherein the at least one stirring boss, within the bearing portion thereof, has a maximum stirring boss depth which defines a maximum diameter of the stirring tool.

9. The stirring tool as claimed in claim 1, wherein the at least one stirring boss has a leading surface for the onflow of the mixture against the stirring boss, wherein the at least one stirring boss has along the leading surface a reduced stirring boss depth.

10. A stirrer for stirring a mixture with a drivable stirring drive and with a stirring tool, connected to the stirring drive, the stirring tool comprising a. a connecting element for connecting the stirring tool to a stirring drive, drivable about a rotational axis of the stirrer, b. a carrier ring, c. a plurality of stirring spokes disposed between the connecting element and the carrier ring, and d. at least one stirring boss, which projects radially on the carrier ring, wherein two adjacent stirring spokes are arranged mutually offset in the direction of the rotational axis;

wherein the stirring spokes respectively have a cross-sectional shape, which is arranged in relation to a stirring tool surface with an angle of inclination different from zero; and wherein the stirring spokes respectively have a stirring spoke height (HS) along said rotational axis which is related to a stirring tool height (HW) along said rotational axis by HS >0.75 HW.

11. A stirring tool for a stirrer for stirring a mixture, wherein the stirring tool comprises a. a connecting element for connecting the stirring tool to a stirring drive, drivable about a rotational axis of the stirrer, b. a carrier ring, c. a plurality of stirring spokes disposed between the connecting element and the carrier ring, and d. at least one stirring boss, which projects radially on the carrier ring, wherein the stirring spokes respectively have a cross-sectional shape, which is arranged in relation to a stirring tool surface with an angle of inclination different from zero;

wherein the at least one stirring boss has a bearing portion for bearing against an inner wall of a stirring vessel; and wherein the at least one stirring boss includes a radial depression so as to provide under the bearing portion a gap in the radial direction between the inner wall of the stirring vessel and the stirring boss.

12. The stirring tool as claimed in claim 11, wherein the at least one stirring boss, with reference to a rotation angle about the rotational axis, is arranged between two stirring spokes.

13. The stirring tool as claimed in claim 11, comprising a plurality of stirring bosses, which are spaced apart around a peripheral direction of the stirring tool.

14. The stirring tool as claimed in claim 11, wherein the stirring spokes respectively have a stirring spoke height which is less than a stirring tool height.

15. The stirring tool as claimed in claim 11, wherein the at least one stirring boss has a mixing portion for mixing the mixture, wherein the at least one stirring boss within the mixing portion has a reduced stirring boss depth.

16. The stirring tool as claimed in claim 11, wherein the at least one stirring boss has a leading surface for the onflow of the mixture against the stirring boss, wherein the at least one stirring boss has along the leading surface a reduced stirring boss depth.

17. The stirring tool as claimed in claim 16, wherein a peripheral angle, related to the rotational axis, of the leading surface amounts to no more than 85% of a peripheral angle of the at least one stirring boss.

18. The stirring tool as claimed in claim 11, comprising a plurality of stirring bosses, wherein respectively two stirring bosses are arranged diametrically opposite one another with respect to the rotational axis.

19. The stirring tool as claimed in claim 11, wherein the stirring spokes respectively have a stirring spoke height ($H_s$) which is related to a stirring tool height ($H_w$), wherein $H_w > H_s > 0.75\ H_w$.

20. The stirring tool as claimed in claim 11, wherein the at least one stirring boss comprises a plurality of spaced apart stirring bosses, wherein each of the stirring bosses, with reference to a rotation angle about the rotational axis, spans an angle that is greater than the angle between two adjacent ones of the stirring bosses.

* * * * *